US010429102B2

(12) United States Patent
Radcliff et al.

(10) Patent No.: US 10,429,102 B2
(45) **Date of Patent: *Oct. 1, 2019**

(54) TWO PHASE LOOP DISTRIBUTED HVACANDR SYSTEM

(71) Applicant: Carrier Corporation, Palm Beach Gardens, FL (US)

(72) Inventors: Thomas D. Radcliff, Vernon, CT (US); Parmesh Verma, South Windsor, CT (US); Dong Luo, South Windsor, CT (US); Richard G. Lord, Murfreesboro, TN (US); Michel Grabon, Bressolles (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/399,564

(22) Filed: Jan. 5, 2017

(65) Prior Publication Data

US 2017/0191711 A1 Jul. 6, 2017

Related U.S. Application Data

(60) Provisional application No. 62/275,110, filed on Jan. 5, 2016, provisional application No. 62/351,017, filed on Jun. 16, 2016.

(51) Int. Cl.
*F25B 49/02* (2006.01)
*F25B 49/00* (2006.01)
(Continued)

(52) U.S. Cl.
CPC ..... *F25B 9/008* (2013.01); *F25B 25/005* (2013.01); *F25B 40/02* (2013.01); *F25B 43/006* (2013.01);
(Continued)

(58) Field of Classification Search
CPC ..... F25B 25/005; F25B 9/008; F25B 13/00; F25B 49/00; F25B 40/02; F25B 3/006;
(Continued)

(56) References Cited

U.S. PATENT DOCUMENTS 3,264,839 A 8/1966 Harnish
4,187,543 A * 2/1980 Healey ..... F24F 11/06 165/208
(Continued)

FOREIGN PATENT DOCUMENTS

WO 2014/137971 A3 11/2014
WO 2015/057297 A1 4/2015
(Continued)

*Primary Examiner* — Ljijana V. Ciric
*Assistant Examiner* — Alexis K Cox
(74) *Attorney, Agent, or Firm* — Cantor Colburn LLP

(57) ABSTRACT

An HVAC&R system including a pumping device configured to circulate a first two-phase medium, a plurality of secondary HVAC&R units, wherein at least one of the plurality of secondary HVAC&R units is operably coupled to the pumping device, and a primary HVAC&R unit operably coupled to at least one of the plurality of secondary HVAC&R units, wherein the pumping device, a portion of the plurality of secondary HVAC&R units, and a portion of the primary HVAC&R unit form a primary loop.

26 Claims, 11 Drawing Sheets

(51) Int. Cl.

| | |
|---|---|
| ***F25B 9/00*** | (2006.01) |
| ***F25B 25/00*** | (2006.01) |
| ***F25B 40/02*** | (2006.01) |
| ***F25B 43/00*** | (2006.01) |

(52) U.S. Cl.
CPC ..... *F25B 49/00* (2013.01); *F25B 2400/06* (2013.01); *F25B 2600/13* (2013.01)

(58) Field of Classification Search
CPC .. F25B 2600/13; F25B 41/04; F25B 2400/16; F25B 2313/025; F25B 5/02; F25B 41/043
USPC ..... 62/498, 513
See application file for complete search history.

(56) References Cited

U.S. PATENT DOCUMENTS 4,430,866 A 2/1984 Willitts
4,732,007 A 3/1988 Dolan et al.
5,366,153 A 11/1994 Swenson
5,701,750 A 12/1997 Ray
5,743,110 A 4/1998 Laude-Bousquet
5,782,101 A 7/1998 Dennis
6,170,270 B1 1/2001 Arshansky et al.
6,185,946 B1 * 2/2001 Hartman ..... F04D 15/029 62/175
6,453,686 B1 9/2002 Alden
6,467,279 B1 10/2002 Backman et al.
6,575,233 B1 6/2003 Krumnow
6,792,766 B2 9/2004 Osborne et al.
6,904,760 B2 6/2005 Butsch
7,150,160 B2 12/2006 Herbert
7,401,472 B2 7/2008 Manole
7,702,423 B2 4/2010 Steiner et al.
7,857,233 B2 12/2010 Trantham
7,900,468 B2 3/2011 Spearing
8,220,531 B2 7/2012 Murakami et al.
8,332,075 B2 12/2012 Harrod
8,539,789 B2 * 9/2013 Kopko ..... F25B 30/02 62/324.5
8,705,423 B2 4/2014 Salsbury et al.
8,733,120 B2 5/2014 Morimoto et al.
8,756,943 B2 6/2014 Chen et al.
8,844,308 B2 9/2014 Martin et al.
9,207,001 B1 12/2015 Roth
9,310,087 B2 4/2016 Grabon et al.
9,470,435 B2 10/2016 Hinde et al.
2005/0133215 A1 * 6/2005 Ziehr ..... B60H 1/00392 165/202
2006/0213219 A1 * 9/2006 Beving ..... F25B 1/04 62/468
2007/0056312 A1 * 3/2007 Kobayashi ..... F25B 7/00 62/335
2008/0289350 A1 11/2008 Shapiro
2010/0031697 A1 * 2/2010 Hinde ..... F25B 7/00 62/498
2010/0043475 A1 2/2010 Taras et al.
2010/0132399 A1 6/2010 Mitra et al.
2010/0242507 A1 9/2010 Meckler et al.
2011/0036113 A1 * 2/2011 Kopko ..... F25B 29/003 62/324.5
2011/0041523 A1 2/2011 Taras et al.
2011/0192189 A1 8/2011 Morimoto et al.
2012/0272669 A1 * 11/2012 Blanton ..... F25B 5/02 62/89
2013/0180278 A1 * 7/2013 Yamashita ..... F25B 6/04 62/335
2014/0033743 A1 2/2014 Hancock
2014/0223939 A1 * 8/2014 Nasuta ..... F25B 30/02 62/160
2014/0245762 A1 * 9/2014 Schlesinger ..... F25B 49/02 62/89
2014/0303835 A1 * 10/2014 VerWoert ..... B60H 1/00742 701/36
2015/0007604 A1 * 1/2015 Hu ..... F28F 9/028 62/507
2015/0108230 A1 4/2015 Cloonan et al.
2015/0167994 A1 6/2015 Josserand et al.
2015/0178421 A1 6/2015 Borrelli et al.
2015/0260437 A1 * 9/2015 Leman ..... F25B 41/046 62/115
2016/0178244 A1 6/2016 Delventura et al.
2016/0245558 A1 8/2016 Feng et al.
2016/0258657 A1 9/2016 Feng et al.

FOREIGN PATENT DOCUMENTS

WO 2015/057299 A1 4/2015
WO 2015/073122 A1 5/2015
WO 2015/140151 A1 9/2015

* cited by examiner

TWO PHASE LOOP DISTRIBUTED HVACANDR SYSTEM

CROSS REFERENCE TO RELATED APPLICATIONS

The present application is related to, and claims the priority benefit of, U.S. Provisional Patent Application Ser. No. 62/275,110 filed Jan. 5, 2016, and U.S. Provisional Patent Application Ser. No. 62/351,017, filed Jun. 16, 2016, the contents of which are hereby incorporated in their entirety by reference into the present disclosure.

TECHNICAL FIELD OF THE DISCLOSED EMBODIMENTS

The presently disclosed embodiments generally relate to heating, ventilation, air conditioning and refrigeration ("HVAC&R") systems, and more particularly, to a two phase loop distributed HVAC&R system.

BACKGROUND OF THE DISCLOSED EMBODIMENTS

Typically, buildings contain HVAC&R systems that include either roof top units or chillers for cooling operation, and direct gas-fired units or boilers for heating operation. In some instances, there is a requirement to simultaneously heat and cool different areas of the building. Typically, conventional HVAC systems incur energy waste by reheating cooled air to maintain comfort for the areas that require heating operation. Typically, these systems use a single phase heat transfer loop, operate at a single temperature lift, and are inefficient at transferring heat between different areas of the building.

Accordingly, there exists a need for a system that can efficiently heat and cool a building simultaneously.

SUMMARY OF THE DISCLOSED EMBODIMENTS

In one aspect, an HVAC&R system is provided. The HVAC&R system includes a pumping device configured to circulate a first two-phase medium, a plurality of secondary HVAC&R units, wherein at least one of the plurality of secondary is operably coupled to the pumping device, and a primary HVAC&R unit operably coupled to at least one of the plurality of secondary HVAC&R units and the pumping device. The pumping device, a portion of each of the plurality of secondary HVAC&R units, and a portion of the primary HVAC&R unit form a primary loop. In an embodiment, the HVAC&R system further includes a valve operably coupled to the pumping device, the valve configured to direct the flow of the first two-phase medium In any embodiment, the HVAC&R system further includes a controller in electrical communication with the pumping device, the valve, each of the plurality of secondary HVAC&R units, and the primary HVAC&R unit. The controller is configured to control the operation of each of the plurality of secondary HVAC&R, the first pumping device, the first valve and the primary HVAC&R unit.

In any embodiment, the HVAC&R system further includes at least one sensing device disposed on the primary loop. The at least one sensing device is configured to determine the state of the first two-phase medium.

In any embodiment, each of the plurality of secondary HVAC&R units include a secondary compressor configured to circulate a second two-phase medium, a first secondary heat exchanger operably coupled to the secondary compressor, a secondary expansion device operably coupled to the first secondary heat exchanger, and a second secondary heat exchanger operably coupled to the secondary expansion device and the secondary compressor. A portion of the primary loop is operably coupled to the first secondary heat exchanger.

In any embodiment, the primary HVAC&R unit includes a primary compressor configured to circulate a third two-phase medium, a first primary heat exchanger operably coupled to the primary compressor, a primary expansion device operably coupled to the first primary heat exchanger, and a second primary heat exchanger operably coupled to the primary expansion device and the primary compressor. A portion of the primary loop is operably coupled to the first primary heat exchanger.

In any embodiment, the first two-phase medium includes carbon dioxide. In any embodiment, the second two-phase medium and the third two-phase medium include a refrigerant.

In any embodiment, each of the plurality of secondary HVAC&R units includes a heat pump. In any embodiment, each of the plurality of secondary HVAC&R units is configured to operate in at least one of a heating mode and cooling mode.

In any embodiment, the primary HVAC&R unit includes a heat pump. In any embodiment, the primary HVAC&R unit is configured to operate in at least one of a heating mode and cooling mode.

In any embodiment, the HVAC&R system further includes an airflow device disposed on the primary loop. The airflow device is configured to direct airflow onto the primary loop. In any embodiment, the HVAC&R system further includes at least one conduit operably coupled to at least one of the plurality of secondary HVAC&R units, and an airflow device operably coupled to the at least one conduit. The airflow device is configured to circulate outdoor air to the at least one of the plurality of secondary HVAC&R units.

In any embodiment, the pumping device is configured to operate at a pumping capacity, each of the plurality of secondary HVAC&R units is configured to operate at a secondary capacity, and the primary HVAC&R unit is configured to operate at a primary capacity. In one embodiment, the controller is configured to vary at least one of the pumping capacity, the secondary capacity and the primary capacity. In one embodiment, varying at least one of the pumping capacity, the secondary capacity and the primary capacity provides a saturated sub-cooled first medium entering the first pumping device.

In any embodiment, the HVAC&R system further includes a first storage device, including a first storage volume therein, disposed on the primary loop and in flow communication with the first pumping device, wherein the first storage device is configured to provide the saturated sub-cooled first medium entering the pumping device.

DETAILED DESCRIPTION OF THE DISCLOSED EMBODIMENTS

Figure 1:
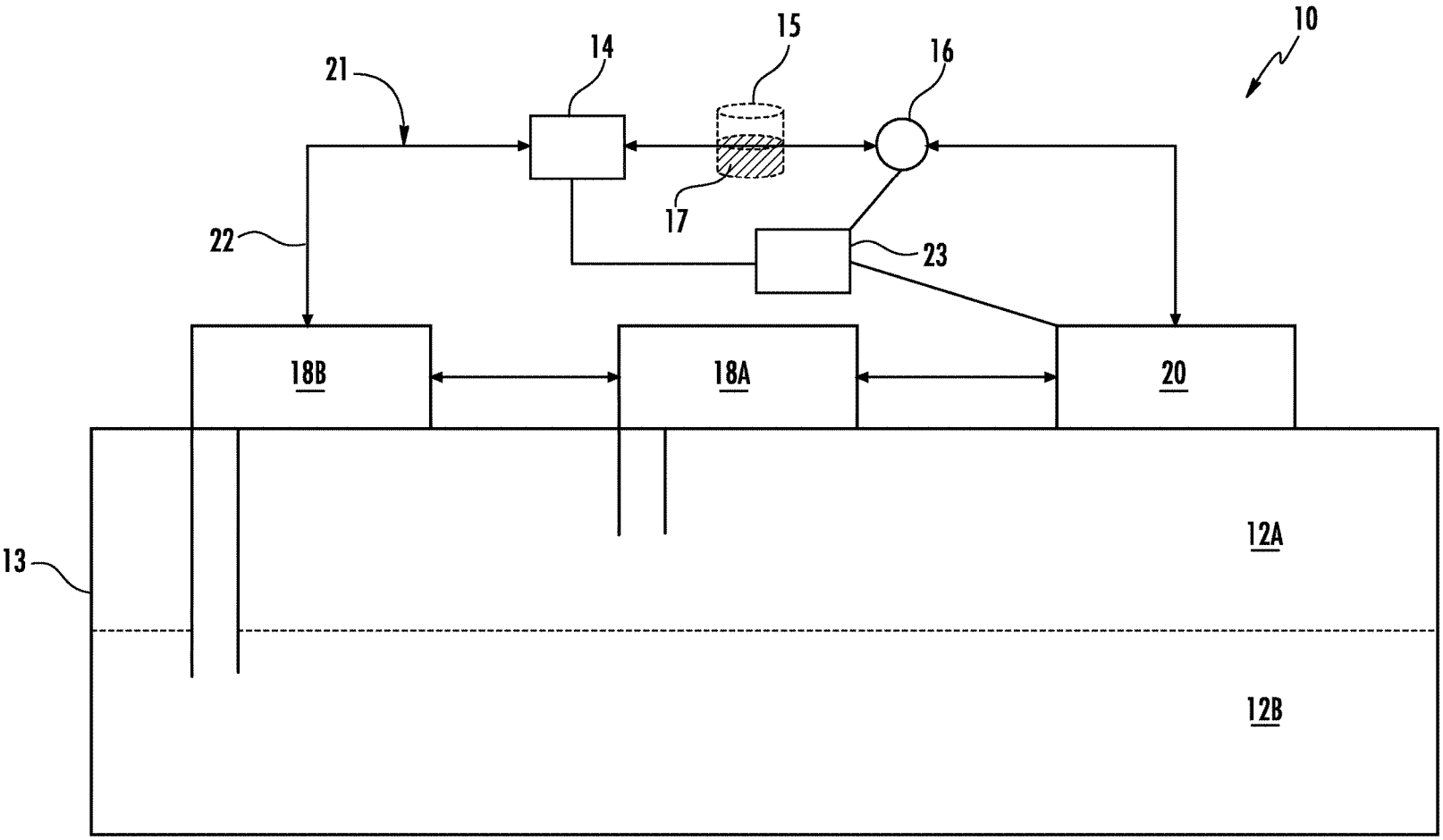
FIG. 1 illustrates a schematic diagram of a HVAC&R system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates an embodiment of an HVAC&R system, generally indicated at 10, configured to condition air within a plurality of interior spaces 12A-B within a structure 13. The HVAC&R system 10 includes a pumping device 14 configured to circulate a first medium 21; a valve 16, for example a four-way valve, operably coupled to the pumping device 14, the valve 16 configured to direct the flow of the first medium 21. The HVAC&R system 10 further includes; a primary HVAC&R unit 20 operably coupled to the valve 16. The HVAC&R system 10 further includes a plurality of secondary HVAC&R units 18A-B operably coupled to the primary HVAC&R unit 20 and the pumping device 14. The pumping device 14, valve 16, plurality of secondary HVAC&R units 18A-B and primary HVAC&R unit 20 are in flow communication with one another to form a primary loop 22. In an embodiment, the plurality of secondary HVAC&R units 18A-B and the primary HVAC&R unit 20 are heat pumps.

The pumping device 14 is configured to circulate the first medium 21 through the primary loop 22, and valve 16 is configured to direct the flow of the first medium 21 in the primary loop 22. In an embodiment, the first medium 21 includes a first two-phase fluid. In an embodiment, the first two-phase fluid includes liquid carbon dioxide. For example, the first two-phase fluid may be at least 50 percent by weight of carbon dioxide. It will be appreciated that the first two-phase fluid may include a percentage weight less than 50 percent. In one embodiment, the first two-phase fluid may be any refrigerant. It will be appreciated that the pumping device 14 is further configured to maintain the first medium 21 in a two-phase state in the secondary loop to minimize heat losses.

Figure 2:
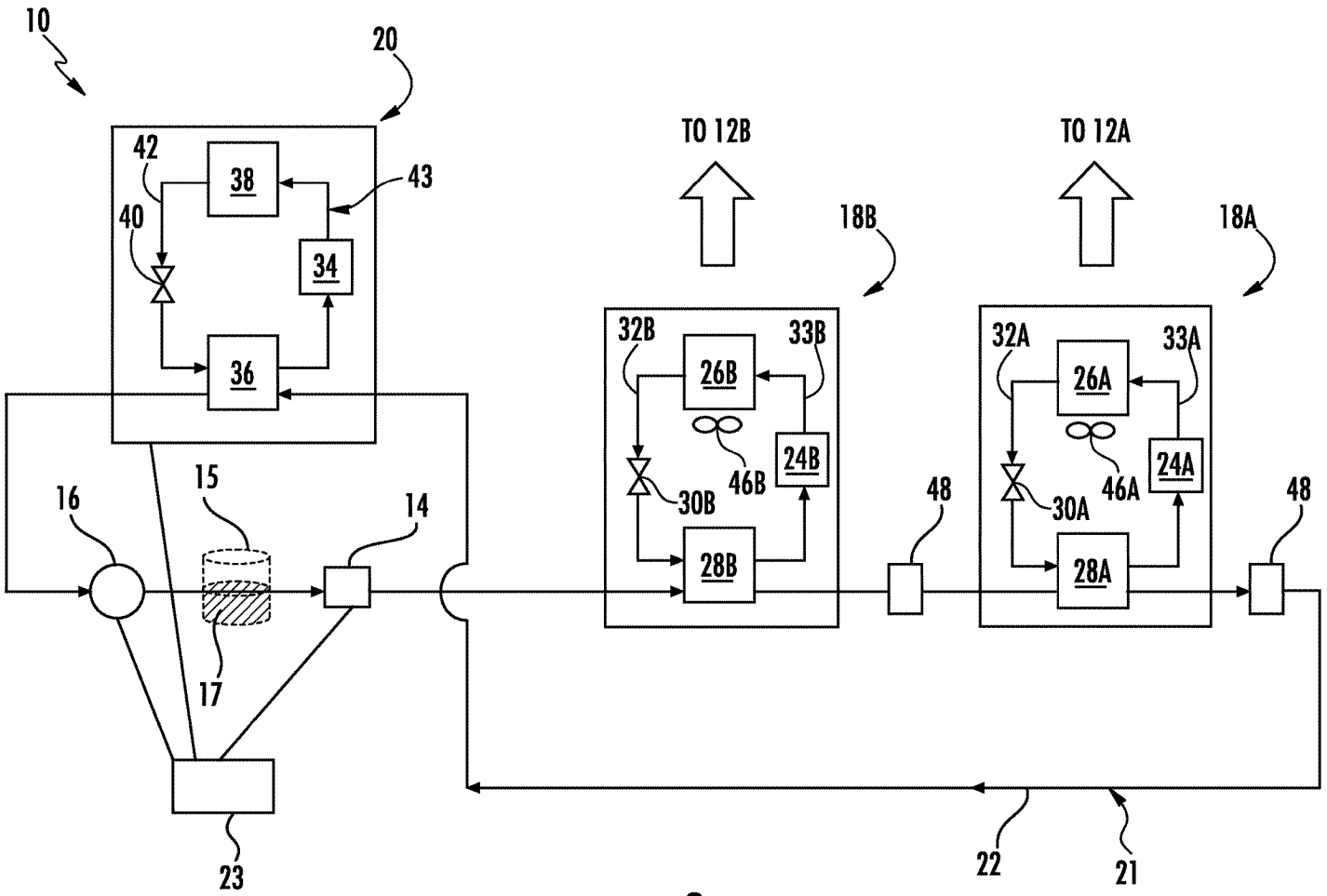
FIG. 2 illustrates a schematic diagram of the HVAC&R system according to an embodiment of the present disclosure.

The plurality of secondary HVAC&R units 18A-B are configured to condition the air within the plurality of interior spaces 12A-B. It will be appreciated that each of the plurality of secondary HVAC&R units 18A-B is capable of providing the capacity needed in each of the plurality of interior spaces 12A-B at a reduced temperature lift of the second medium 33A-B as it flows between the first secondary heat exchanger 28A-B and the second secondary heat exchanger 26A-B (as shown in FIG. 2), respectively. Energy rejected or absorbed by any of the plurality of secondary HVAC&R units 18A-B may be accessed by downstream secondary HVAC&R units 18 with zero temperature change in the first medium 21 due to heat exchange. It will further be appreciated that the plurality of secondary HVAC&R units 18 may be arranged in series or parallel. The primary HVAC&R unit 20 is configured to heat or cool the first medium 21, as later described herein.

The HVAC&R system 10 further includes a controller 23 in electrical communication with the pumping device 14, the valve 16, each of the plurality of secondary HVAC&R units 18A-B, and the primary HVAC&R unit 20. The controller 23 is configured to control the operation of the primary HVAC&R unit 20, and the pumping device 14 to process, circulate and direct the flow of the first medium 21. In an embodiment, the controller 23 is further configured to control the operation of the valve 16 to direct the flow of the first medium 21.

In an embodiment, the controller 23 is configured to vary the capacity of at least one of the pumping device 14 and the primary HVAC&R unit 20 to conserve energy and reduce the temperature lift required to meet the required demand. In some embodiments, the capacity of the pumping device 14 and the primary HVAC&R unit 20 may be varied to ensure that the first medium 21 enters the pumping device 14 as saturated subcooled liquid. Based on pressure and temperature of the first medium 21 measured at the inlet of the pumping device 14, the controller 23 may adjust the speed of pumping device 14 in the primary loop 22 and the speed/stage of primary compressor 34 (shown in FIGS. 3-5, 7-11).

In a cooling dominant mode, if the measured temperature of the first medium 21 is lower than a saturation temperature at a measured pressure by less than a given threshold, e.g., approximately 0.5° C., the controller 23 may decrease the speed of the pumping device 14 and increase the speed/stage of the primary compressor 34 if needed. If the measured temperature of the first medium 21 is lower than the saturation temperature at the measured pressure by more than a given threshold, e.g., approximately 5.0° C., the controller 23 may decrease the speed/stage of primary compressor 34 and increase the speed of pumping device 14 if needed.

In heating dominant mode, if the measured temperature of the first medium 21 is lower than a saturation temperature at a measured pressure by less than a given threshold, e.g., approximately 0.5° C., the controller 23 may decrease the speed/stage of primary compressor 34 and decrease the speed of the pumping device 14 if needed. If the measured temperature of the first medium 21 is lower than the saturation temperature at the measured pressure by more than a given threshold, e.g., approximately 5.0° C., the controller 23 may increase the speed of the pumping device 14 and increase the speed/stage of primary compressor 34, if needed. In some embodiments, a first storage device 15 including a first storage volume 17 may be used before the pumping device 14 for this purpose.

FIG. 2 provides another view of the HVAC&R system 10. In the embodiment shown, each of the plurality of secondary HVAC&R units 18A-B includes a secondary compressor 24, a second secondary heat exchanger 26, a first secondary heat exchanger 28, and a secondary expansion device 30 in flow communication with one another to form an independent secondary HVAC&R loop 32 within each secondary HVAC&R unit 18A-B in which a second medium 33 is circulated therethrough. In an embodiment, the second medium 33 includes a second two-phase fluid. In an embodiment, the second two-phase fluid includes a refrigerant. It will be appreciated that the second medium 33 may be the same medium or a different medium within the plurality of secondary HVAC&R units 18.

The primary HVAC&R unit 20 includes a primary compressor 34, a first primary heat exchanger 36, a second primary heat exchanger 38, and a primary expansion device 40 in flow communication with one another to form an independent third HVAC&R loop 42 in which a third medium 43 is circulated therethrough. In an embodiment, the third medium 43 includes a third two-phase fluid. In an embodiment, the third two-phase fluid includes a refrigerant.

The HVAC&R system 10 is configured such that the primary loop 22 passes through the first secondary heat exchanger 28 of each of the plurality of secondary HVAC&R units 18A-B and through the first primary heat exchanger 36.

For an illustration of operation of the HVAC&R system 10, assume interior space 12B has a cooling demand greater than a heating demand for interior space 12A. It will be appreciated that the system 10 will determine the overall demand of the structure 13 as a function of a heating demand, cooling demand, or a combination of the demand of the plurality of interior spaces 12A-B. When the cooling demand is greater, controller 23 transmits a signal to the primary HVAC&R unit 20 to operate in a cooling mode. As such, the primary compressor 34 begins to pump high-pressure, high-temperature third medium 43 vapor into the second primary heat exchanger 38. The third medium 43 is cooled into high-pressure, high-temperature liquid and goes through the primary expansion device 40 where it becomes low-pressure, low-temperature two phase fluid. Thereafter, the low-pressure, low-temperature two phase fluid enters the first primary heat exchanger 36. Simultaneously, pumping device 14 circulates the first medium 21 through valve 16. The first medium 21 is directed through the first primary heat exchanger 36 and as the first medium 21 flows through the first primary heat exchanger 36 heat is exchanged from first medium 21 to the low-pressure, low-temperature two phase third medium 43.

The absorption of heat in the third medium 43 flowing through first primary heat exchanger 36 causes the third medium 43 to return to a low-pressure, low-temperature vapor state. The low-pressure, low-temperature vapor enters the primary compressor 34 where it turns into a high-pressure, high-temperature vapor. Thereafter, the high-pressure, high-temperature vapor enters the second primary heat exchanger 38 where the third medium 43 releases heat to external fluid, for example, ambient air, and condenses into a high-pressure, high-temperature liquid. The high-temperature liquid travels back through the expansion device 40 where it becomes low-pressure, low-temperature two phase fluid and returns to the primary heat exchanger 36.

To condition spaces 12A (heating) and 12B (cooling), the now cooled first medium 21 liquid is directed to the secondary HVAC&R unit 18B. Secondary HVAC&R unit 18B operates in a cooling mode due to the cooling demand in interior space 12B. As such secondary compressor 24B pumps high-pressure, high-temperature second medium 33B vapor through the first secondary heat exchanger 28B. The first medium 21 and the second medium 33B simultaneously flow through the first secondary heat exchanger 28B, and as a result, the second medium 33B vapor releases heat into the first medium 21 causing the first medium 21 to contain more vapor and causes the second medium 33B to return to a high-pressure, high-temperature liquid state.

The now high-pressure, high-temperature second medium 33B liquid enters the secondary expansion device 30B where it turns into a low-pressure, low-temperature two phase fluid. Thereafter, the low-pressure, low-temperature two phase fluid enters the second secondary heat exchanger 26B where fan 46B blows air across the second secondary heat exchanger 26B to send cool air into interior space 12B.

The two phase first medium 21 continues to flow to the secondary HVAC&R unit 18A. The secondary HVAC&R unit 18A is operating in a heating mode to condition the interior space 12A. Here, the secondary compressor 24A pumps high-pressure, high temperature second medium 33A vapor through a reversing valve (not shown), and the high-pressure, high-temperature refrigerant vapor flows through the second secondary heat exchanger 26A. The second medium 33A releases heat in the air as fan 46A blows air across the second secondary heat exchanger 26A to send warm air into interior space 12A. The second medium 33A turns into a high-pressure, high-temperature liquid when it enters secondary expansion device 30A where it changes state to a low-pressure, low-temperature two phase fluid and enters the first secondary heat exchanger 28A.

The first medium 21 and the second medium 33A simultaneously flow through the first secondary heat exchanger 28A, and as a result the low-pressure, low-temperature two-phase second medium 33A absorbs heat from the two phase first medium 21 to change the second medium 33A to a low-pressure, low-temperature vapor before it reenters the secondary compressor 24A. As a result, the temperature lift of the second medium 33A is effectively reduced; thus, increasing the efficiency of the HVAC&R system 10 and providing heat to space 18A.

As the heat from the first medium 21 is absorbed into the second medium 33A, the first medium 21 returns to a liquid state where it reenters the first primary heat exchanger 36 to begin the cycle again. It will be appreciated that the flow of the first medium 21, the second medium 33A-B, and the third medium 43 may be reversed depending on the mode of operation (i.e., heating or cooling).

Figure 3:
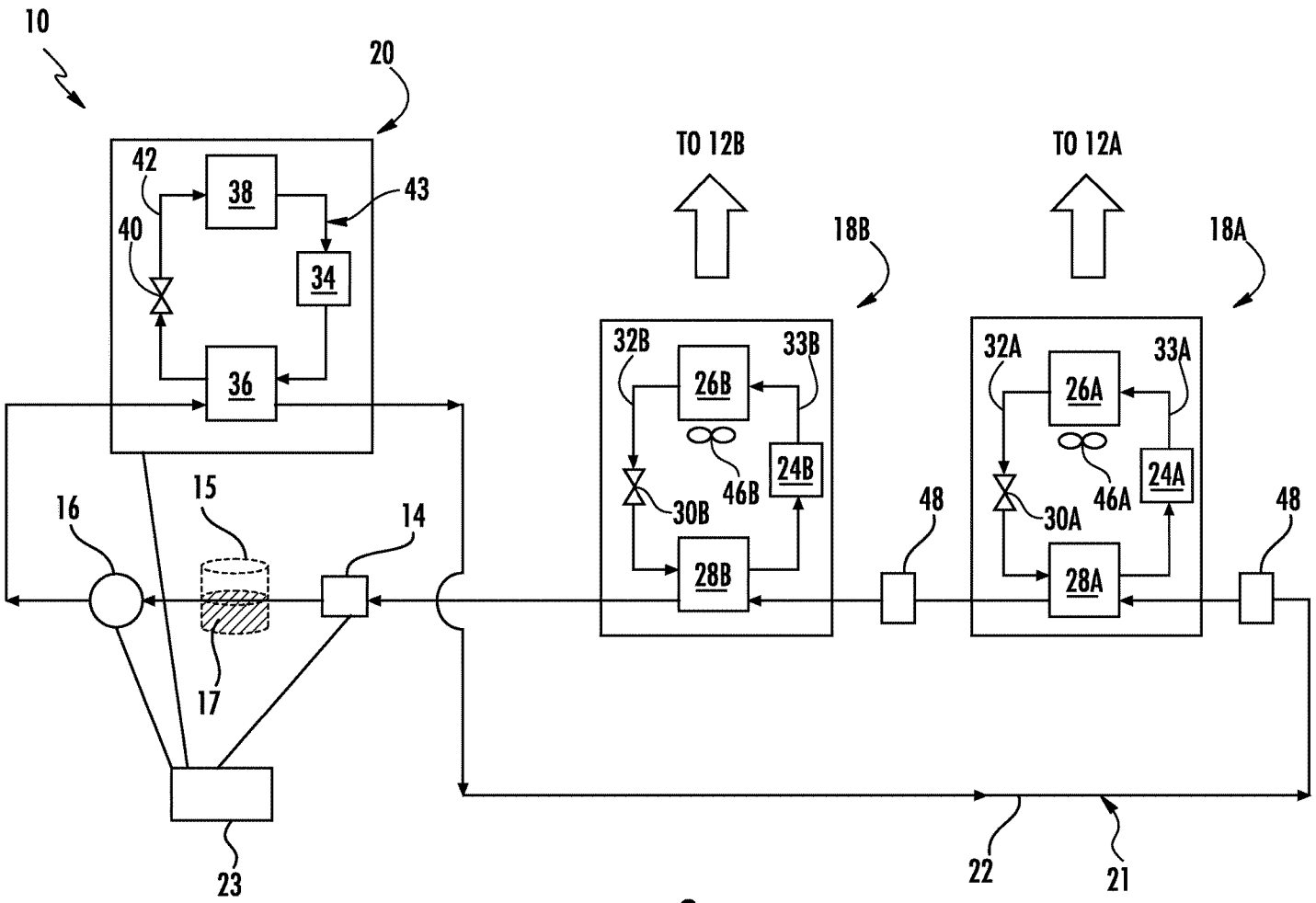
FIG. 3 illustrates a schematic diagram of the HVAC&R system in an all heating mode according to an embodiment of the present disclosure.

For example, the flow of the first medium 21, the second medium 33A-B, and the third medium 43 in an all heating mode is shown in FIG. 3. The first medium 21 flows from the pumping device 14, through the valve 16, through the first primary heat exchanger 36, through the first secondary heat exchangers 28A and 28B of the respective secondary HVAC&R units 18A-B, back to the pumping device 14. The second medium 33A-B flows from the secondary compressor 24A-B through the second secondary heat exchanger 26A-B, through the secondary expansion device 30, and through the first secondary heat exchanger 28A-B before returning to the secondary compressor 24. The third medium 43 flows from the primary compressor 34 to the first primary heat exchanger 36, through the primary expansion device 40, and through the second primary heat exchanger 38 before returning to the primary compressor 34. It will be appreciated that any of the secondary HVAC&R units 18A-B may be off.

Figure 4:
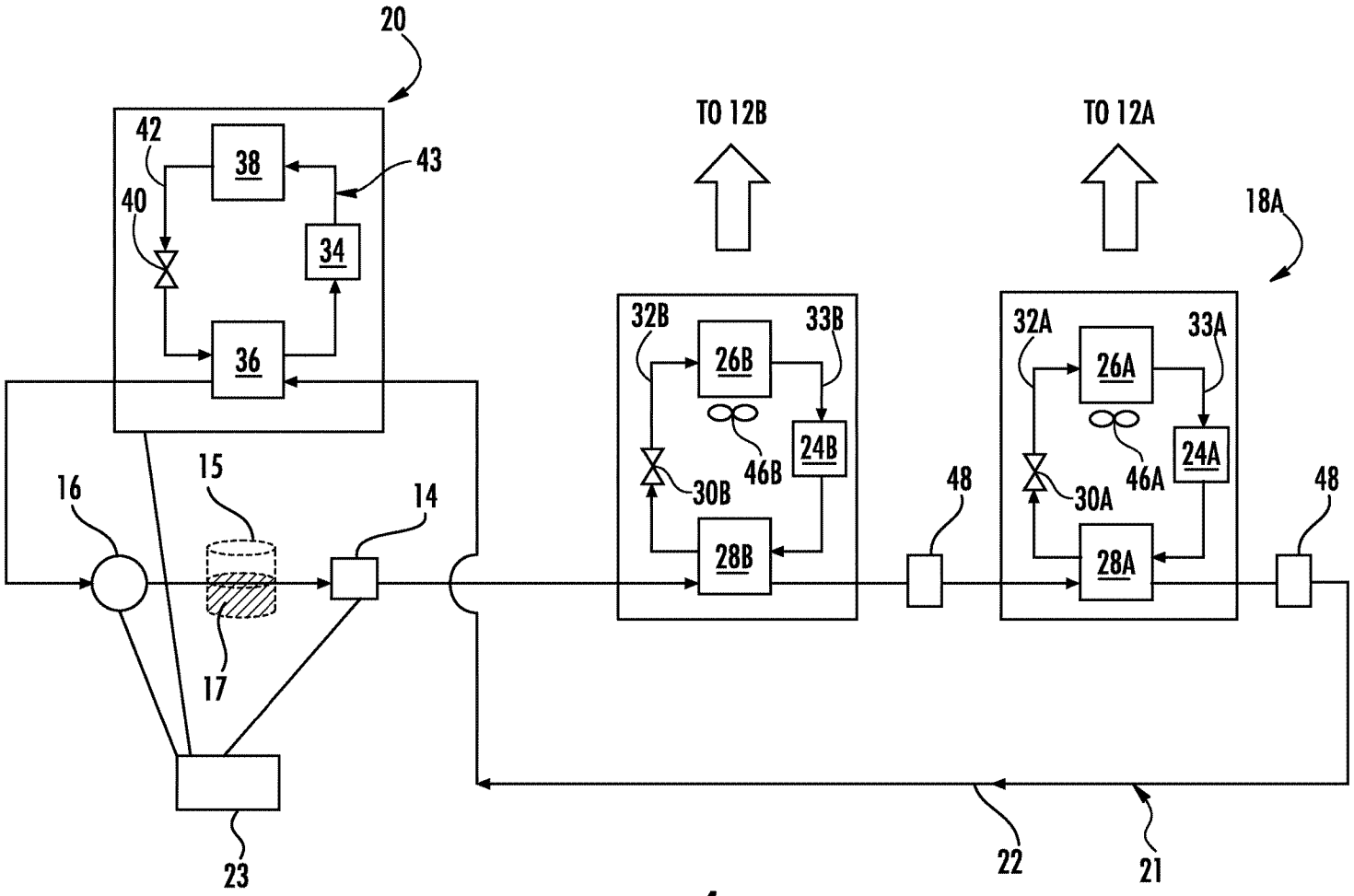
FIG. 4 illustrates a schematic diagram of the HVAC&R system in an all cooling mode according to an embodiment of the present disclosure.

For example, the flow of the first medium 21, the second medium 33A-B, and the third medium 43 in an all cooling mode is shown in FIG. 4. The first medium 21 flows from the pumping device 14, through the first secondary heat exchangers 28A-B of the respective secondary HVAC&R units 18A-B, through the first primary heat exchanger 36, and through the valve 16 before returning to the pumping device 14. The second medium 33A-B flows from the secondary compressor 24A-B through the first secondary heat exchanger 28A-B, through the secondary expansion device 30, and through the second secondary heat exchanger 26A-B, before returning to the secondary compressor 24. The third medium 43 flows from the primary compressor 34 to the second primary heat exchanger 38, through the primary expansion device 40, and through the first primary heat exchanger 36 before returning to the primary compressor 34. It will be appreciated that any of the secondary HVAC&R units 18A-B may be off.

In some embodiments, a sensing device 48 (as shown in FIGS. 2-11) is disposed on the primary loop 22. The sensing device 48 is configured to monitor the fluid state of the first medium to ensure the first medium does not become significantly subcooled or superheated, and to maintain some subcooling at the inlet of the pumping device 14 to prevent cavitation by varying the primary HVAC unit 20 and the pumping device 14 through the controller 23.

Figure 5:
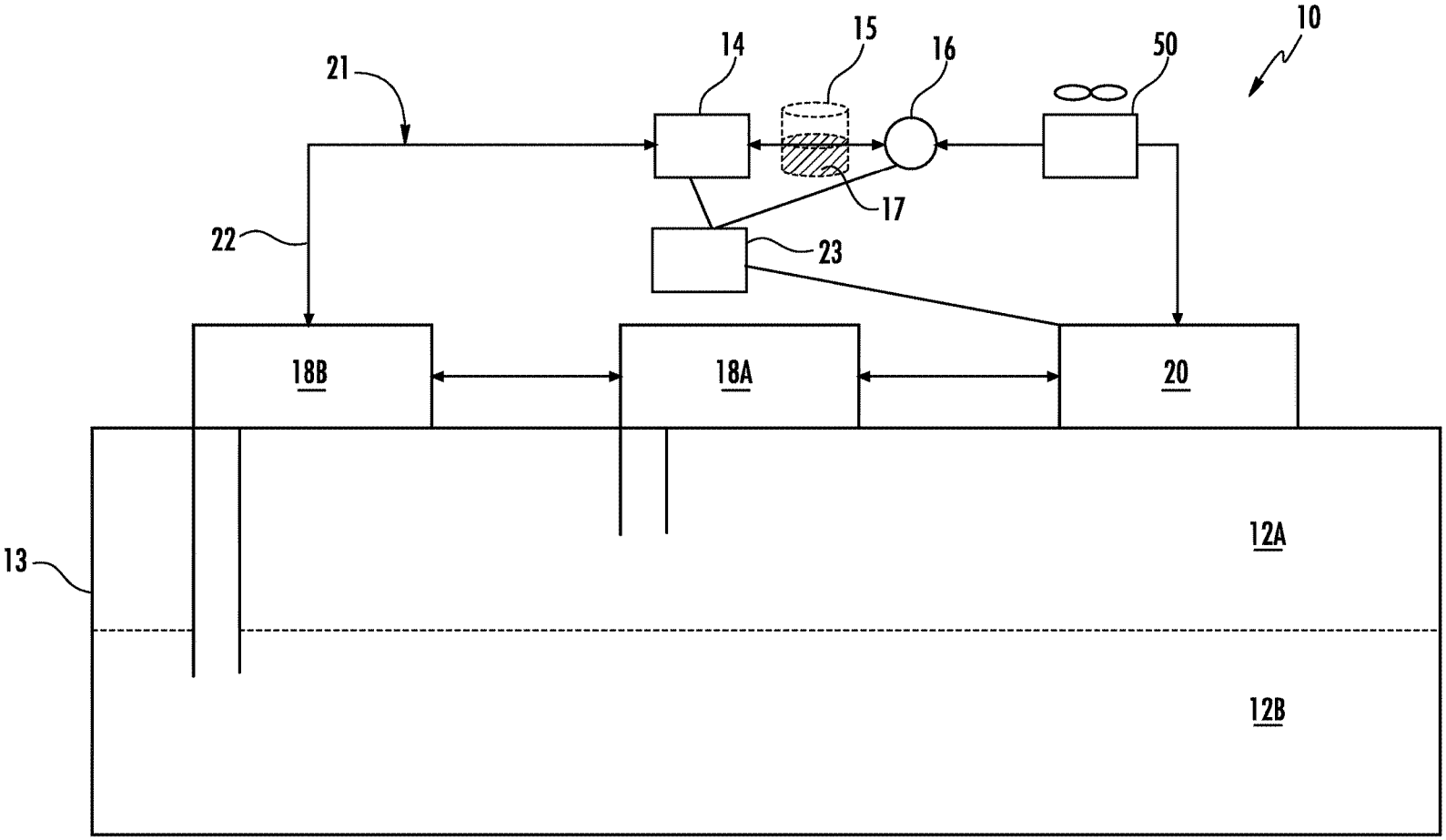
FIG. 5 illustrates a schematic diagram of the HVAC&R system with an airflow device according to an embodiment of the present disclosure.

As shown in the embodiment of FIG. 5, an airflow device 50, for example an economizer, is disposed adjacent to the primary loop 22. The airflow device 50 is configured to direct outdoor air onto the primary loop 22 to effectively cool the first medium 21 as it flows therethrough. For example, when the outdoor air temperature is at or below a given temperature effective to cool the first medium 21, the pumping device 14 may circulate the first medium 21 through the primary loop 22 in a cooling mode configuration. As the first medium 21 passes the airflow device 50 the first medium 21 is partly or fully condensed before it enters the primary HVAC&R unit 20 and the plurality of secondary HVAC&R units 18A-B. The condensed first medium 21 absorbs heat from the flowing second medium within the plurality of secondary HVAC&R units 18A-B.

Figure 6:
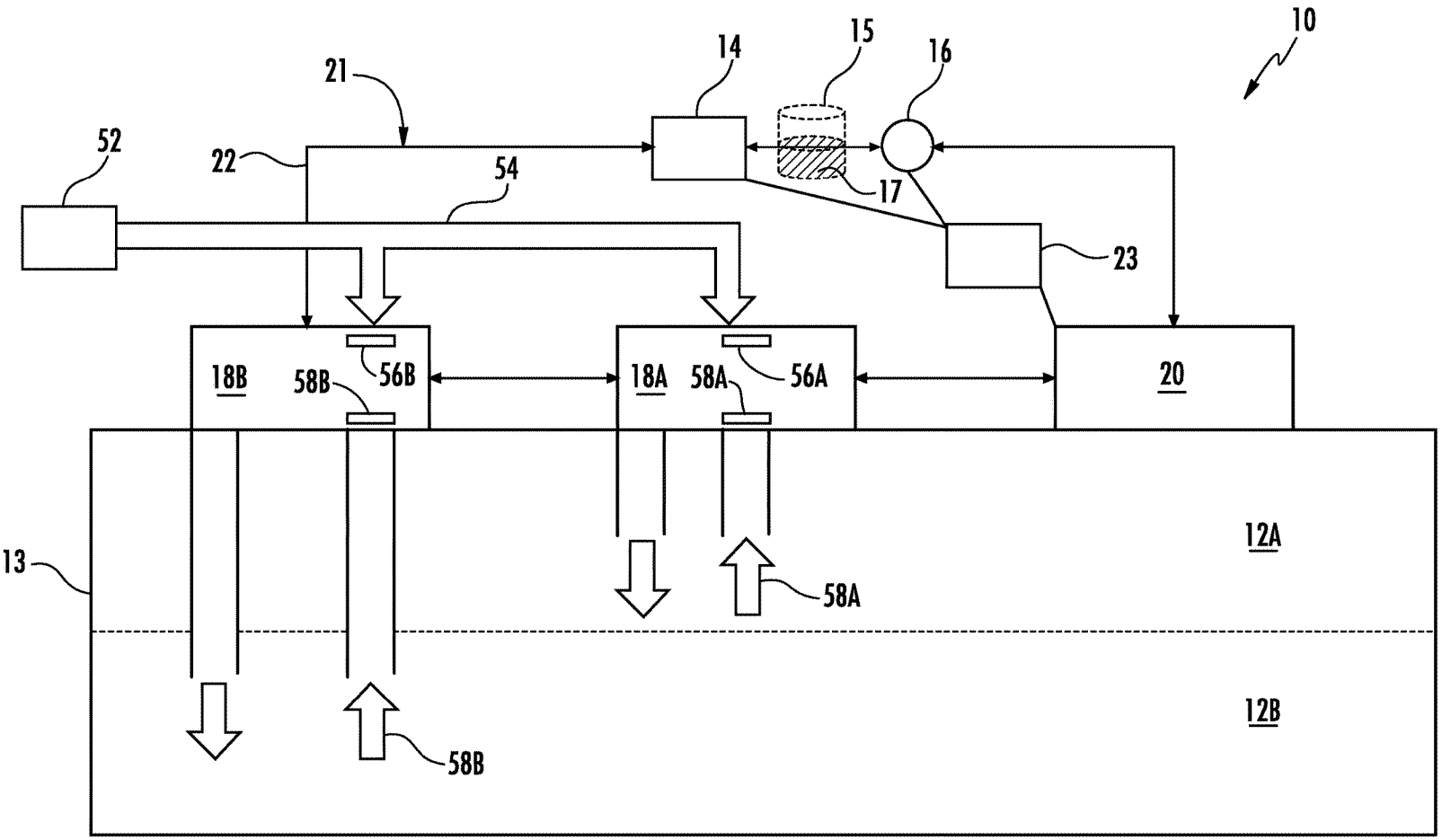
FIG. 6 illustrates a schematic diagram of the HVAC&R system with an airflow device according to another embodiment of the present disclosure.

As shown in the embodiment of FIG. 6, an airflow device 52 is in airflow communication with at least one of the plurality of secondary HVAC&R units 18A-B. The airflow device 52 is configured to deliver outdoor air to at least one of the plurality of secondary HVAC&R units 18A-B. For example, outdoor air is delivered to at least one of the plurality of secondary HVAC&R units 18A-B via a conduit 54. The outdoor air enters at least one of the plurality of secondary HVAC&R units 18A-B via a damper 56A or 56B where it is mixed with return air 58A or 58B from the interior space 12A or 12B, respectively. The now mixed air is pulled across the second secondary heat exchanger 26A or 26B via the fan 46A or 46B (as shown in FIGS. 2-4) to deliver conditioned air to the interior space 12A or 12B. When a space is in cooling mode, device 52 is controlled to increase the flow rate of outdoor air when the outdoor air condition is appropriate to reduce or eliminate the mechanical cooling load on the secondary HVAC&R units 18A-B.

Figure 7:
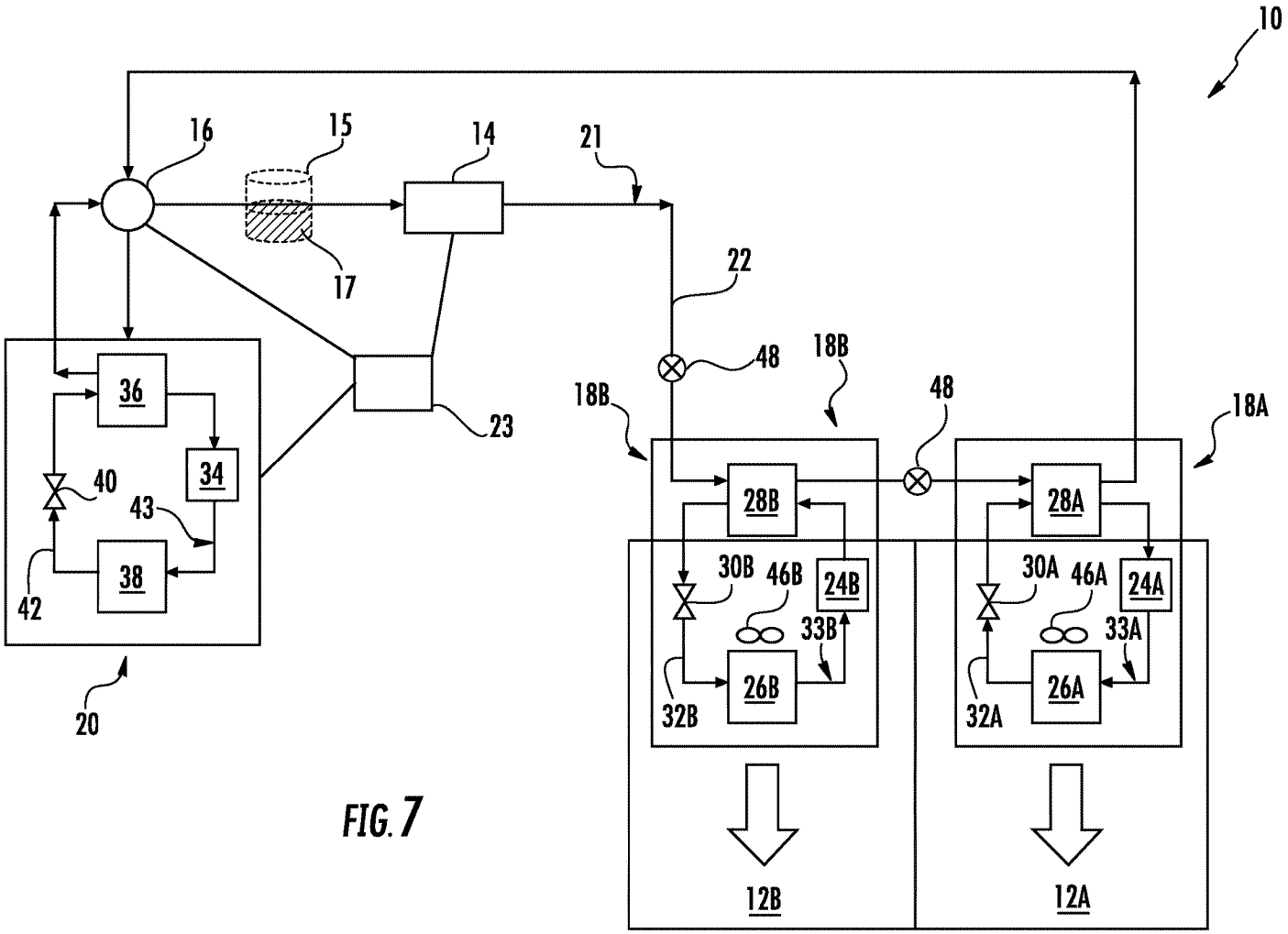
FIG. 7 illustrates a schematic diagram of the HVAC&R system according to an embodiment of the present disclosure.
Figure 8:
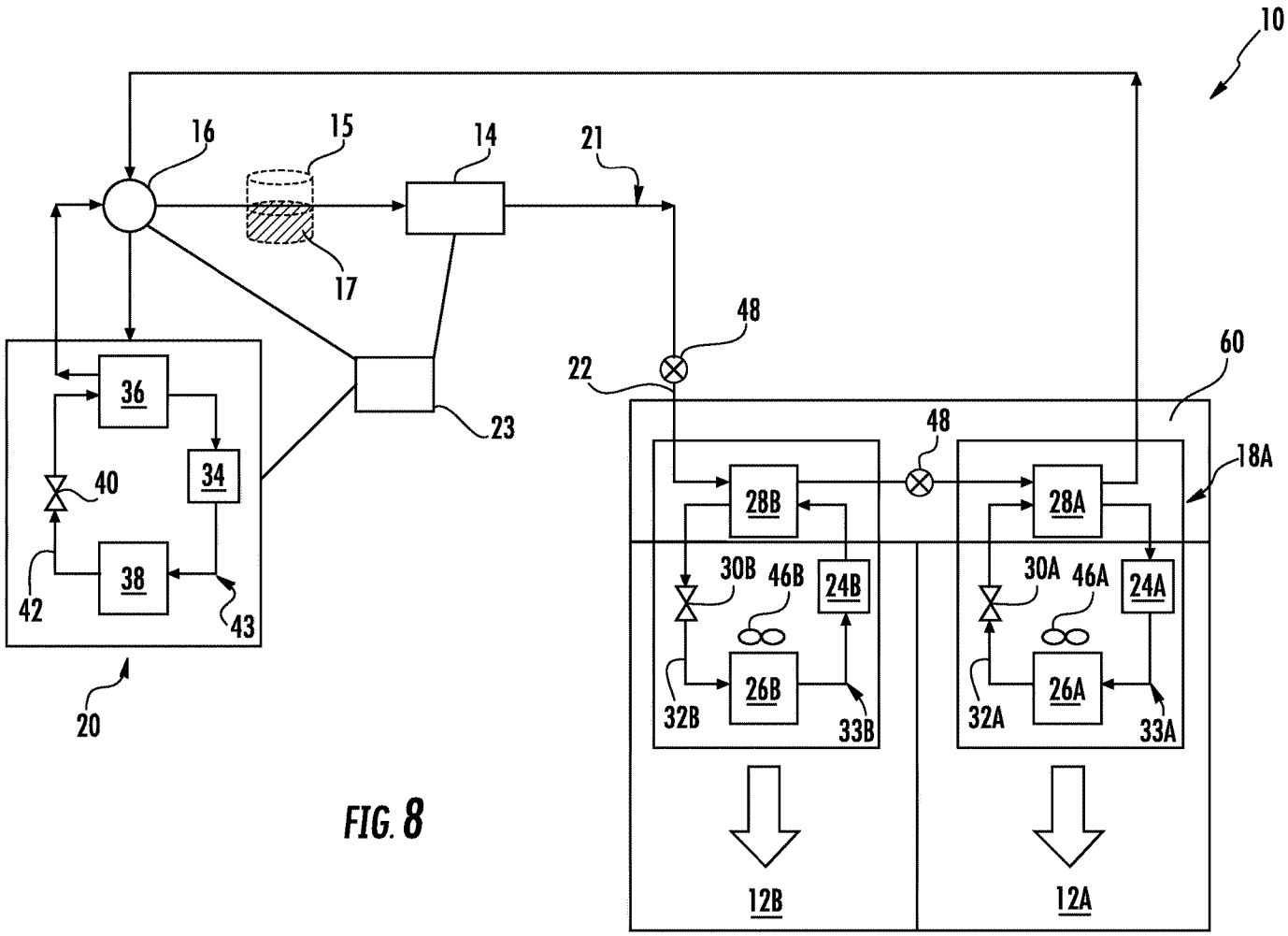
FIG. 8 illustrates a schematic diagram of the HVAC&R system according to an embodiment of the present disclosure.

In one embodiment, as shown in FIG. 7, a portion of the secondary HVAC&R units 18A-B may be disposed within the interior space 12A-B, respectively. In an embodiment, the secondary compressor 24, the second secondary heat exchanger 26, and the secondary expansion device 30 are disposed within the interior space 12A-B. In another embodiment, as shown in FIG. 8 a first portion of the secondary HVAC&R units 18A-B may be disposed within the interior space 12A-B, respectively, and a second portion of the secondary HVAC&R units 18A-B may be disposed within a secondary interior space 60. In an embodiment, the secondary interior space 60 is an unoccupied space.

Placing a portion(s) of the secondary HVAC&R units 18A-B within the interior space 12A-B, respectively and/or secondary interior space 60 is operable to mitigate the risks associated with the amount of the first medium 21 that may enter the occupied interior space 12A-B. For example, if there is a leak in the primary loop 22, the first medium 21 may be properly contained in a mechanically ventilated restricted area (secondary interior space 60) or naturally vented outside (as shown in FIG. 7).

Figure 9:
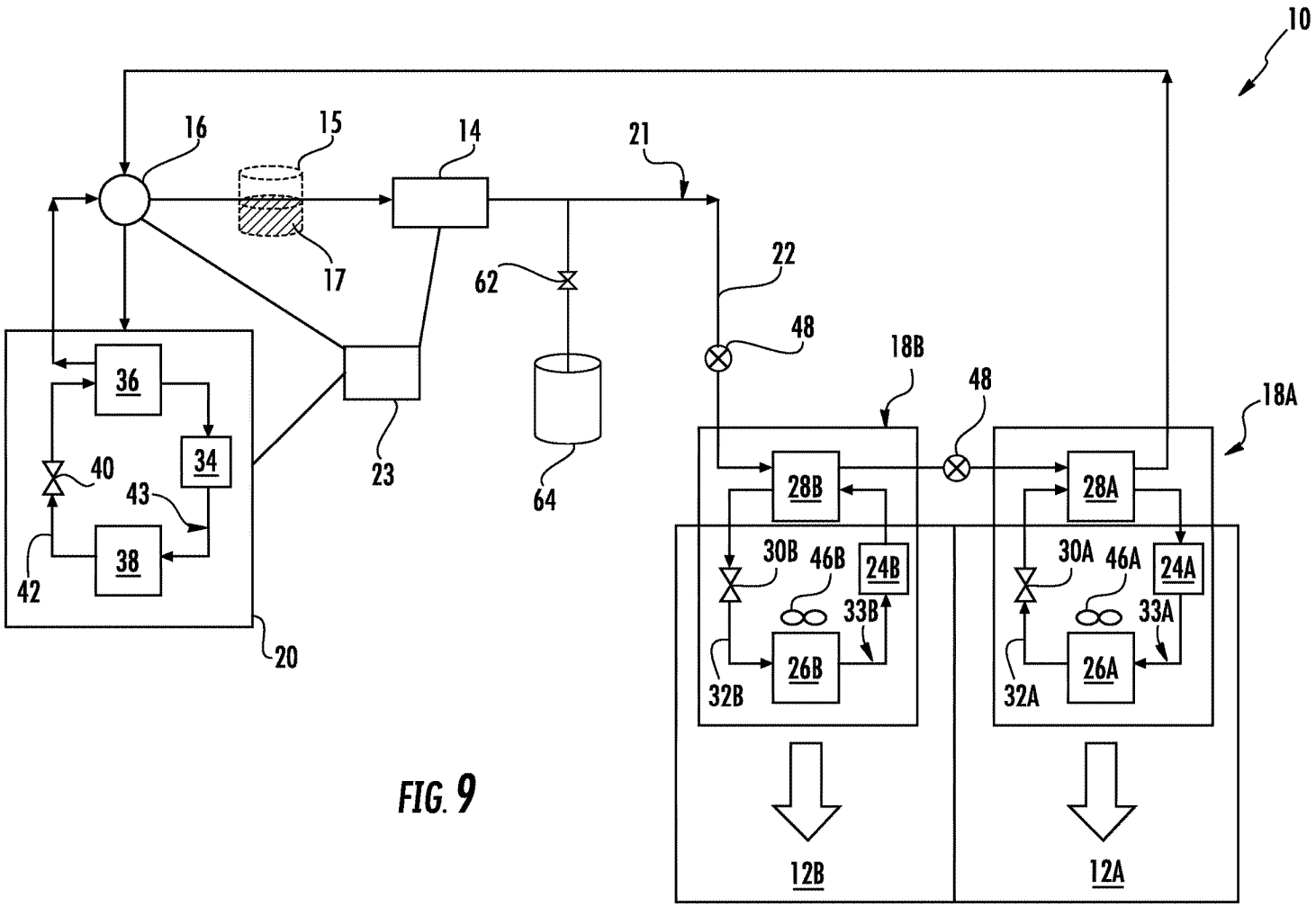
FIG. 9 illustrates a schematic diagram of the HVAC&R system with a pressure control assembly according to an embodiment of the present disclosure.

In an embodiment, as shown in FIG. 9, a second valve 62 is operably coupled to the primary loop 22 between the pumping device 14 and one of the secondary HVAC&R units 18A-B. A pressure container 64 is operably coupled to the second valve 62.

Using the second valve 62 and pressure container 64 is operable to maintain positive pressure within the primary loop 22 in cold ambient temperature conditions, and maintain the design pressure in hot ambient temperature conditions by preventing non-condensable gases from leaking into the two-phase loop during extremely cold weather, and avoiding release during extremely hot weather. In other embodiments, the HVAC&R system 10 is operable to maintain positive pressure within the primary loop 22 in cold ambient temperature conditions, and maintain the design pressure in hot ambient temperature conditions by directing exhaust air over the storage device 15 to pre-heat or pre-cool the primary loop 22. It is also operable to maintain positive pressure within the primary loop 22 in cold ambient temperature conditions by operating the pump device 14.

Figure 10:
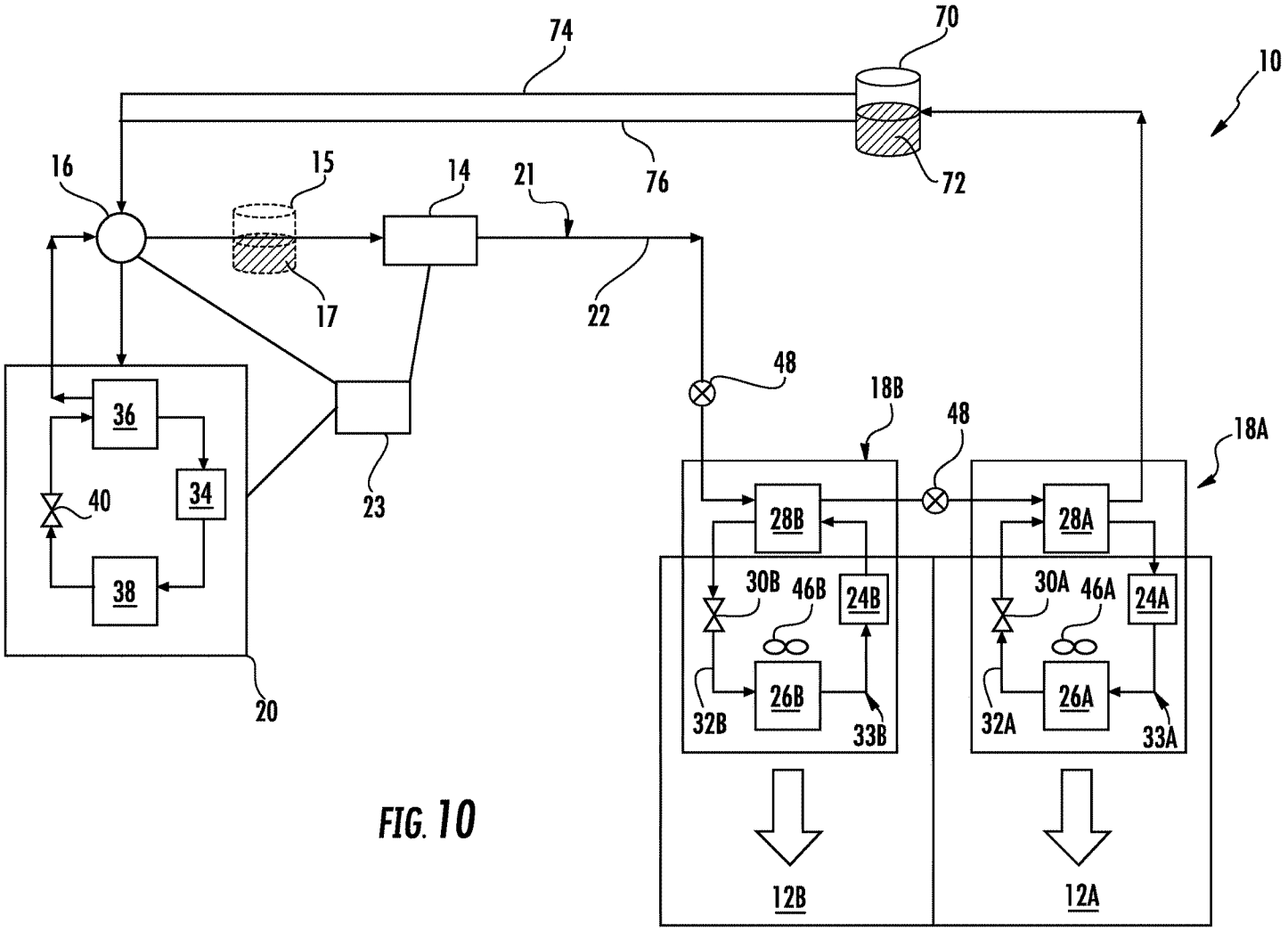
FIG. 10 illustrates a schematic diagram of the HVAC&R system charge reduction assembly according to an embodiment of the present disclosure.

In an embodiment, as shown in FIG. 10, the system 10 further includes a second storage device 70 containing a second storage volume 72. In an embodiment, the second storage volume includes a two-phase fluid. The second storage device 70 is disposed within the primary loop 22 between valve 16 and one of the secondary HVAC&R units 18A-B. The second storage device 70 is operably coupled valve 16 via a vapor conduit 74 located in a position above the second storage volume 72, and a liquid conduit 76 located in a position such that the second storage volume 72 may flow therethrough. In an embodiment, the diameter of the vapor conduit 74 is larger than the diameter of the liquid conduit.

By separating the vapor and the liquid of the two-phase fluid retuning to the primary HVAC unit 20, the second storage device 70, vapor conduit 74, and liquid conduit 76 operate to effectively reduce an overall charge of the two-phase fluid within the system 10. The overall system charge of the system 10 is reduced based on the vapor and liquid traveling at the same pressure drop within the vapor conduit 74 and liquid conduit 76, respectively. Because the liquid phase has a higher density than the vapor, the liquid conduit 76 may be smaller in size (i.e. diameter); thus, reducing the flow area.

Figure 11:
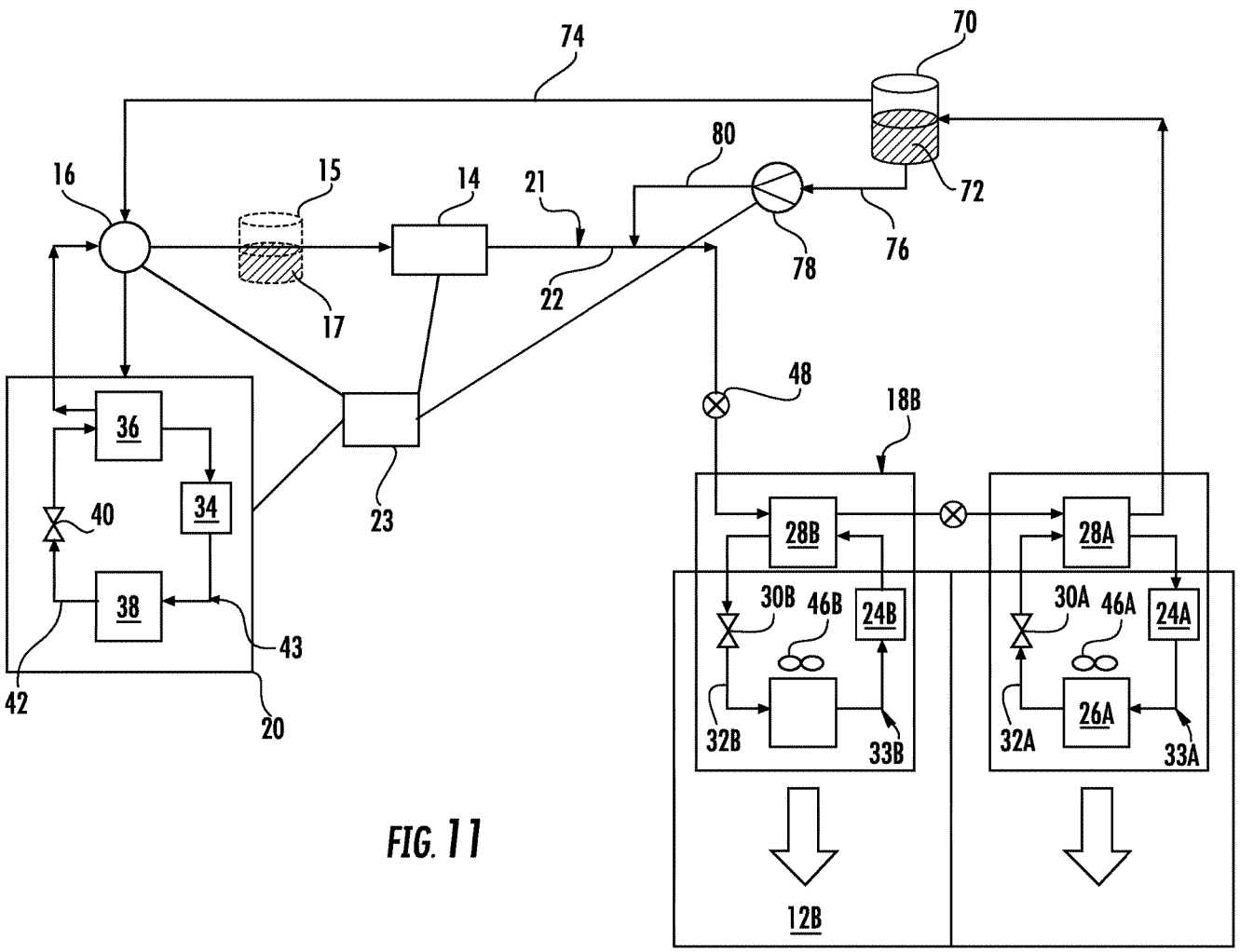
FIG. 11 illustrates a schematic diagram of the HVAC&R system charge reduction assembly according to an embodiment of the present disclosure.

In an embodiment, as shown in FIG. 11, a second pumping device 78 is operably coupled to the primary loop 22 between the second storage device 70 and one of the secondary HVAC&R units 18A-B. In the embodiment shown, the fluid conduit 76 is operably coupled to an inlet of the second pumping device 76. In an embodiment, the controller 23 is operably coupled to the second pumping device 23 for the control thereof. The outlet of the second pumping device 30 is operably coupled to the primary loop 22 before one of the secondary HVAC&R units 18A-B. This configuration also effectively reduces the overall charge of the system 10 and improves the energy efficiency by circulating the second storage volume 72 back in to the supply for the secondary HVAC&R units 18A-B.

Any "pump" or "pumping" term included in the present disclosure, such as the pumping device 14, refers to a fluid pumping device in one or more embodiments, and refers to a liquid and/or gas pumping device in one or more additional embodiments of the present disclosure. Further, any heat pump or heat pumping device described or identified herein may include a non-vapor, compression-based heat pumping device or another solid state heat pumping device in one or more embodiments, as well as a conventional heat pump device in one or more embodiments.

It will therefore be appreciated that the present embodiments include an HVAC&R system 10 including a two-phase fluid flowing through a primary loop 22 to interconnect a primary HVAC&R unit 20 with independently controlled secondary HVAC&R units 18A-B to more efficiently heat and cool interior spaces 12A and 12B by effectively reducing the temperature lift of the second medium 33A-B within the plurality of secondary HVAC&R units 18A-B.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An HVAC&R system comprising:

a first pumping device configured to circulate a first medium, the first medium includes a first two-phase fluid;

a plurality of secondary HVAC&R units, wherein at least one of the plurality of secondary HVAC&R units is operably coupled to the first pumping device, wherein at least one of the plurality of secondary HVAC&R units is configured to operate in a heating mode and a cooling mode;

a primary HVAC&R unit operably coupled to at least one of the plurality of secondary HVAC&R units and the first pumping device;

a controller; and at least one sensing device;

wherein the first pumping device, a portion of each of the plurality of secondary HVAC&R units, and a portion of the primary HVAC&R unit form a primary fluid loop wherein the at least one sensing device is disposed on at least the first primary loop, wherein the at least one sensing device is configured to monitor the pressure and temperature of at least the first medium in the first primary loop, wherein the controller is configured to prevent cavitation in the first pumping device by varying the operation of at least the first primary HVAC&R unit and the first pumping device to maintain the subcooling of the first medium at an inlet of the first pumping device using the monitored pressure and temperature;

wherein each of the plurality of secondary HVAC&R units includes a secondary compressor and a first secondary heat exchanger operably coupled to the secondary compressor, wherein the secondary compressor is configured to circulate a second medium, the second medium includes a second two-phase fluid;

wherein a portion of the primary fluid loop is operably coupled to the first secondary heat exchanger.

2. The HVAC&R system of claim 1 further comprising a first valve operably coupled to the first pumping device, the first valve configured to direct the flow of the first medium.

3. The HVAC&R system of claim 2, wherein the controller is in electrical communication with the first pumping device, the first valve, each of the plurality of secondary HVAC&R units, and the primary HVAC&R unit, wherein the controller is further configured to control the operation of each of the plurality of secondary HVAC&R, the first pumping device, the first valve and the primary HVAC&R unit.

4. The HVAC&R system of claim 3, wherein the controller is configured to vary at least one of the pumping capacity, the secondary capacity and the primary capacity.

5. The HVAC&R system of claim 4, wherein varying at least one of the pumping capacity, the secondary capacity and the primary capacity provides the first medium as a saturated sub-cooled liquid entering the first pumping device.

6. The HVAC&R system of claim 5, further comprising a first storage device disposed on the primary loop and in flow communication with the first pumping device, wherein the first storage device is configured to store a first storage volume comprising the saturated sub-cooled liquid, wherein the first storage device is further configured to provide the saturated sub-cooled first liquid to the first pumping device.

7. The HVAC&R system of claim 5, further comprising:

a second valve disposed on the primary fluid loop and in flow communication with the first pumping device; and a pressure container device operably coupled to the second valve;

wherein the second valve and pressure container are effective to regulate a pressure within the primary fluid loop.

8. The HVAC&R system of claim 1, wherein each of the plurality of secondary HVAC&R units further includes:

a secondary expansion device operably coupled to the first secondary heat exchanger; and a second secondary heat exchanger operably coupled to the secondary expansion device and the secondary compressor;

wherein the secondary compressor, the second secondary heat exchanger the first secondary heat exchanger, and the secondary expansion device form an independent secondary fluid loop within each of the plurality of secondary HVAC&R units;

wherein the second medium circulates within each secondary loop.

9. The HVAC&R system of claim 8, wherein the second two-phase fluid includes a refrigerant.

10. The HVAC&R system of claim 8, wherein the secondary compressor, the secondary expansion device, and the second secondary heat exchanger of each of the plurality of secondary HVAC&R units are disposed within a first interior space of a building.

11. The HVAC&R system of claim 8, wherein the first secondary heat exchanger of each of the plurality of the secondary HVAC&R units is disposed within a second interior space of the building, wherein the second interior space is a mechanically ventilated restricted area of the building.

12. The HVAC&R system of claim 1, wherein at least one of the plurality of secondary HVAC&R units is a compression-based non-vapor heat pumping device that is thermally coupled to the first medium.

13. The HVAC&R system of claim 1, wherein the primary HVAC&R unit comprises:

a primary compressor configured to circulate a third medium, the third medium includes a third two-phase fluid;

a first primary heat exchanger operably coupled to the primary compressor;

a primary expansion device operably coupled to the first primary heat exchanger; and a second primary heat exchanger operably coupled to the primary expansion device and the primary compressor;

wherein a portion of the primary fluid loop is operably coupled to the first primary heat exchanger.

14. The HVAC&R system of claim 13, wherein the third two-phase fluid includes a refrigerant.

15. The HVAC&R system of claim 1, wherein the first two-phase fluid includes liquid carbon dioxide.

16. The HVAC&R system of claim 1, wherein each of the plurality of secondary HVAC&R units comprises a heat pump.

17. The HVAC&R system of claim 1, wherein the primary HVAC&R unit comprises a heat pump.

18. The HVAC&R system of claim 1, further comprising an airflow device disposed on the primary loop, the airflow device configured to direct airflow onto the primary loop.

19. The HVAC&R system of claim 1, further comprising:

at least one conduit operably coupled to at least one of the plurality of secondary HVAC&R units; and an airflow device operably coupled to the at least one conduit;

wherein the airflow device is configured to circulate outdoor air to the at least one of the plurality of secondary HVAC&R units that are operably coupled to the at least one conduit.

20. The HVAC&R system of claim 1, wherein the primary HVAC unit is configured to operate in at least one of a heating mode and cooling mode.

21. The HVAC&R system of claim 1, wherein the first pumping device is configured to operate at a pumping capacity, each of the plurality of secondary HVAC&R units is configured to operate at a secondary capacity, and the primary HVAC unit is configured to operate at a primary capacity.

22. The HVAC&R system of claim 1, further comprising a second storage device disposed on the primary fluid loop and in communication with a valve and at least one of the plurality of secondary HVAC&R units; wherein the second storage device comprises a second storage volume therein.

23. The HVAC&R system of claim 22, wherein the second storage volume includes the first two-phase fluid.

24. The HVAC&R system of claim 22, further comprising a second pumping device disposed on the primary fluid loop and in communication with the second storage device and at least one of the plurality of secondary HVAC&R units.

25. The HVAC&R system of claim 24, wherein the controller is configured to control the operation of second pumping device.

26. The HVAC&R system of claim 1, further comprising:

a primary compressor included in the primary HVAC&R unit and configured to circulate a third medium;

wherein a direction of flow of each of the first medium, the second medium, and the third medium is individually reversible.

* * * * *